US010524324B2

(12) United States Patent
Yadav et al.

(10) Patent No.: US 10,524,324 B2
(45) **Date of Patent: *Dec. 31, 2019**

(54) LED LIGHTING FIXTURE AND ADJUSTMENT OF COLOR TEMPERATURE THEREOF BASED AT LEAST IN PART ON DETECTED TOGGLE INPUT

(71) Applicant: Hubbell Incorporated, Shelton, CT (US)

(72) Inventors: Pritam Yadav, Greenville, SC (US); T. Warren Weeks, Jr., Simpsonville, SC (US); Douglas M. Hamilton, Arlington Heights, IL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/245,741

(22) Filed: Jan. 11, 2019

(65) Prior Publication Data

US 2019/0150246 A1 May 16, 2019

Related U.S. Application Data

(63) Continuation of application No. 15/875,326, filed on Jan. 19, 2018, now Pat. No. 10,187,951, which is a continuation of application No. 15/429,732, filed on Feb. 10, 2017, now Pat. No. 9,907,134.

(60) Provisional application No. 62/293,619, filed on Feb. 10, 2016.

(51) Int. Cl.
*H05B 37/02* (2006.01)
*H05B 33/08* (2006.01)

(52) U.S. Cl.
CPC ..... *H05B 33/0857* (2013.01); *H05B 33/0809* (2013.01); *H05B 33/0824* (2013.01); *H05B 33/0845* (2013.01); *H05B 33/0863* (2013.01); *H05B 33/0887* (2013.01); *H05B 33/086* (2013.01)

(58) Field of Classification Search
CPC ..... H05B 33/086; H05B 33/0887
USPC ..... 315/185 R, 291, 308, 360, 362
See application file for complete search history.

(56) References Cited

U.S. PATENT DOCUMENTS

| | | | |
|---|---|---|---|
| 6,379,022 | B1 | 4/2002 | Amerson et al. |
| 7,002,546 | B1 | 2/2006 | Stuppi et al. |
| 8,294,379 | B2 | 10/2012 | Liu et al. |
| 8,436,553 | B2 | 5/2013 | Zampini |
| 8,829,804 | B2 | 9/2014 | Radermacher |

(Continued)

OTHER PUBLICATIONS

PCT International Search Report for corresponding PCT Application No. PCT/US17/17389, dated Jun. 8, 2017—4 pages.

(Continued)

*Primary Examiner* — Thuy V Tran
(74) *Attorney, Agent, or Firm* — Dority & Manning, P.A.

(57) ABSTRACT

Lighting fixtures and methods for controlling operation of lighting fixtures are provided. In one example implementation, a lighting fixture includes a first LED array associated with a first color temperature, and a second LED array associated with a second color temperature. The lighting fixture further includes a circuit configured to adjust a power distribution amongst the first LED array and the second LED array based at least in part on a detected toggle input to adjust a color temperature of light output by the lighting fixture.

19 Claims, 5 Drawing Sheets

(56) References Cited

U.S. PATENT DOCUMENTS

| | | | | |
|---|---|---|---|---|
| 2007/0159008 | A1 | 7/2007 | Bayat et al. | |
| 2012/0139446 | A1 | 6/2012 | Koren et al. | |
| 2015/0351169 | A1* | 12/2015 | Pope | H05B 33/086 315/193 |
| 2015/0351191 | A1* | 12/2015 | Pope | H05B 33/0863 315/294 |
| 2016/0105941 | A1 | 4/2016 | Liu | |
| 2016/0165681 | A1 | 6/2016 | Nankil et al. | |

OTHER PUBLICATIONS

GRE Alpha LED Power Specialists, XS Switch Dim "Momentary Switch Dimming Module," Product Spec Sheet, 2017—4 pages.

* cited by examiner

LED LIGHTING FIXTURE AND ADJUSTMENT OF COLOR TEMPERATURE THEREOF BASED AT LEAST IN PART ON DETECTED TOGGLE INPUT

PRIORITY CLAIM

The present application is a continuation of U.S. application Ser. No. 15/875,326, titled "Toggle Control for Lighting System," filed on Jan. 19, 2018, and corresponding U.S. Pat. No. 10,187,951 having an issue date of Jan. 22, 2019. The '326 application is a continuation of U.S. application Ser. No. 15/429,732, titled "Toggle Control for Lighting System," filed on Feb. 10, 2017, and corresponding U.S. Pat. No. 9,907,134 having an issue date of Feb. 27, 2018. The '732 application claims the benefit of priority of U.S. Provisional Application Ser. No. 62/293,619, titled "Toggle Control for LED Lighting System," filed Feb. 10, 2016, which is incorporated herein by reference.

FIELD

The present disclosure relates generally to lighting systems.

BACKGROUND

LED lighting systems can include one or more LED devices that become illuminated as a result of the movement of electrons through a semiconductor material. LED devices are becoming increasingly used in many lighting applications and have been integrated into a variety of products, such as light fixtures, indicator lights, flashlights, and other products. LED lighting systems can provide increased efficiency, life and durability, can produce less heat, and can provide other advantages relative to traditional incandescent and fluorescent lighting systems. Moreover, the efficiency of LED lighting systems has increased such that higher power can be provided at lower cost to the consumer.

Lighting systems can include control interfaces to allow users to adjust the light output of LED arrays using, for instance, dimming controls. As an example, dimming controls can be used to vary the color temperature or other lighting effects of a lighting system having a plurality of LED arrays using a dimmer device. A dimmer device can include a manually adjustable element that facilitates adjustment of the light output of a lighting system as the dimmer device is manually adjusted from, for instance, a first position to a second position. Dimmer devices are not always available or desired in every lighting system.

In many cases only a toggle switch or other single throw circuit interrupter is available for the control of light output by a lighting system. A single throw circuit interrupter can be operated in two or more states. For instance, a single throw circuit interrupter can be placed in an off state to turn the light output of the lighting system off. The single throw circuit interrupter can be placed in an on state to turn the light output of the lighting system on.

SUMMARY

Aspects and advantages of embodiments of the present disclosure will be set forth in part in the following description, or may be learned from the description, or may be learned through practice of the embodiments.

One example aspect of the present disclosure is directed a light emitting diode (LED) system. The system can include a first LED array having one or more LED devices and a second LED array having one or more LED devices. The system can further include a single throw circuit interrupter configured to receive power from a power source. The system can further include a power conversion circuit configured to convert an input power received via the toggle switch to a power output for the first LED array and the second LED array. The power conversion circuit can be configured to control a power distribution ratio between the first LED array and the second LED array based at least in part on a detected toggle input (e.g., a toggle pattern) implemented using the single throw current interrupter.

Other example aspects of the present disclosure are directed to systems, methods, apparatus, circuits, and electronic devices for controlling a lighting system using a toggle switch.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
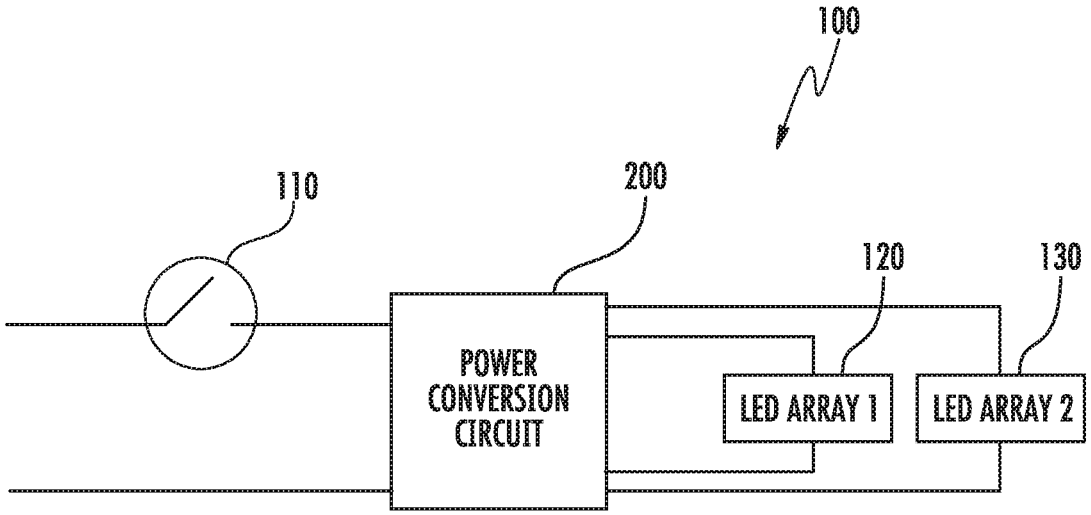
FIG. 1 depicts an overview of an example system according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a solid state lighting system, such as a light emitting diode (LED) lighting system. Aspects of the present disclosure are discussed with reference to LED solid state light sources for purposes of illustration and discussion. Those of ordinary skill in the art, using the disclosures provided herein, will understand that aspects of the present technology can be used with other light sources without deviating from the scope of the present disclosure.

In some implementations, a lighting system can include a plurality of LED arrays. Each LED array can include one or more LED devices. Each LED array can be associated with a different color temperature, different color, different brightness, different lighting direction or other characteristic. The lighting system can include a power conversion circuit configured to control an output of each of the LED arrays (e.g., by providing a driving current to the LED arrays). In some implementations, the power conversion circuit can control power delivery (e.g., a driving current for driving the LEDs) to each of the LED arrays to adjust a ratio of light output among the plurality of LED arrays to provide desired lighting effects.

According to particular aspects of the present disclosure, the lighting system can include a circuit interrupter, such as a single throw circuit interrupter that can be configured to control power delivery to the plurality of LED arrays in the LED lighting system. A single throw circuit interrupter can include, for instance, an ON/OFF circuit interrupter, such as a toggle switch, relay (mechanical, electrical or digital), single-pole-single-throw (SPST) switch, a double-pole-single-throw (DPST) switch, etc. Aspects of the present disclosure will be discuss with reference to a toggle switch for purposes of illustration and discussion. Those of ordinary skill in the art, using the disclosures provided herein, will understand that aspects of the present disclosure can be implemented using any suitable single throw circuit interrupter without deviating from the scope of the present disclosure.

In some embodiments, a power conversion circuit can be configured (e.g., using power line communication (PLC) protocols) to detect various toggle patterns (e.g., changes in state during a time period) input via a single throw circuit interrupter. The power conversion circuit can be configured to adjust the light output of each of the LED arrays based on the detected toggle patterns input via the single throw circuit interrupter. In this way, the light output of the lighting system can be controlled using a simple single throw circuit interrupter without the need for dimmers or other lighting control circuits (e.g., DALI lighting control circuits, DMX lighting control circuits, 0-10V lighting control circuits, etc.).

For instance, in one implementation, a user can provide a first toggle input (e.g., a first toggle pattern comprising one or more changes in state over a time period) via the toggle switch to trigger the power conversion circuit to implement a power distribution sweep over a range of different power distributions (e.g., current splits) or ratios for the plurality of LED arrays. For instance, the power conversion circuit can increase a driving current provided to the first LED array over time while at the same time decreasing a driving current provided to the second LED array over time. This will cause the light output of the LED lighting system to be swept over a range of different light outputs during a time period. When a desired light output is achieved, the user can provide a second toggle input (e.g., a second toggle pattern comprising one or more changes in state during a time period) via the toggle switch to stop the power distribution sweep and to control the light output of the LED arrays based on the power distribution (e.g., current split) at the time of the second toggle input.

As one example, an LED lighting system can include a first LED array having one or more LED devices associated with a first color temperature and a second LED array having one or more LED devices associated with a second color temperature. In response to a toggle input received via a toggle switch, the power conversion circuit according to example embodiments of the present disclosure can adjust the ratio of power distribution (e.g., driving current) over time provided to the first LED array relative to the second LED array. As a result, the amount of light emitted by the first LED array at a first color temperature can be adjusted over time relative to the amount of light emitted by the second LED array at a second color temperature. This can result in a sweep of the light output of the LED lighting system over a range of different overall color temperatures. When a desired color temperature is achieved, a second toggle input can be used to control the power conversion circuit to stop adjusting the ratio of current provided to the first LED array and second LED array and therefore lock in or hold the light output of the lighting system at the desired color temperature.

As another example, a lighting system can include a first LED array associated with a first lighting direction (e.g., to provide uplighting) and a second LED array associated with a second lighting direction (e.g., to provide downlighting). In response to a toggle input received via a toggle switch, the power conversion circuit according to example embodiments of the present disclosure can adjust over time the ratio of power distribution (e.g., driving current) provided to the first LED array relative to the current provided to the second LED array. As a result, the amount of light emitted by the first LED array in the first direction can be adjusted over time relative to the amount of light emitted by the second LED array in the second direction. When a desired lighting effect of the light output of the lighting system is achieved, a second toggle input can be used to control the power conversion circuit to stop adjusting the ratio of power distribution provided to the first LED array and second LED array and therefore lock in or hold the light output of the lighting system to provide a desired lighting effect.

In some embodiments, the power distribution (e.g., current split) among the plurality of the LED arrays can include a memory device to store previous power distributions among the plurality of LED arrays set using the toggle switch. In this example embodiment, a desired power distribution among the plurality of LED devices to provide a desired light output (e.g., desired color temperature, desired lighting effect, etc.) can be implemented by simply turning on the LED arrays with the toggle switch without having to implement a power distribution sweep using various toggle inputs with the toggle switch.

As used herein, a "lighting system" can include, but is not limited to, one or more of a lighting circuit, light engine, one or more light fixtures (i.e., luminaires), a plurality of lighting devices arranged in an environment, a combination of any of the foregoing, or other system used to provide illumination. A "light fixture" or "luminaire" refers to a device used to provide light or illumination using one or more light sources. The term "about" or "approximately" when used in conjunction with a numerical value refers to within 35% of the stated numerical value.

In addition, the present disclosure makes reference to a first toggle input, a second toggle input, a third toggle input, etc., provided using a toggle switch. The use of the terms "first," "second," and "third," are used to differentiate between the different toggle inputs and are not used to indicate either magnitude or order of sequence of the toggle inputs provided via a toggle switch.

FIG. 1 depicts an example LED lighting system 100 according to example embodiments of the present disclosure. The LED lighting system 100 includes a toggle switch 110, a power conversion circuit 200, and a plurality of LED arrays, including a first LED array 120 and a second LED array 130. While two LED arrays are illustrated in FIG. 1, those of ordinary skill in the art, using the disclosure provided herein will understand that any number of LED arrays can be used in the lighting system 100 without deviating from the scope of the present disclosure.

Each of the first LED array 120 and the second LED array 130 can include one or more LED devices. The LED devices can emit light (e.g. visible light, ultraviolet light, infrared light, or other light or electromagnetic energy) as a result of electrons moving through a semiconductor material. In particular example implementations, the first LED array 120 can be associated with a different color temperature relative to the second LED array 130.

The present disclosure is discussed with reference to LED arrays having different color temperatures for purposes of illustration and discussion. The LED arrays can include many other suitable variations without deviating from the scope of the present disclosure. For instance, the LED arrays can be associated with a different brightness, different color, different spectral distribution, different lighting direction, different layout, or other suitable characteristics. The LED arrays can be implemented on the same circuit board or on different circuit boards.

The lighting system 100 can receive power for powering the LED arrays 120 and 130 from a power source (not shown). The power source can be a suitable alternating current (AC) or direct current (DC) power source. In some embodiments, the power source comprises an AC circuit having, for instance, a hot-wire and a neutral wire to provide 120 V single phase AC power.

The toggle switch 110 can be used to control power delivery to the lighting system 100. For instance, the toggle switch 110 can be manually manipulated by a user to control the delivery of power to the lighting system 100. In some embodiments, the toggle switch 110 can be controlled remotely (e.g., over a wired or wireless network). The toggle switch 110 can be configured to interrupt one of the conductors providing power to the power conversion circuit 200 from the power source 100. For instance, the toggle switch 110 can be configured to open or close a hot wire conductor of a 110 V single phase AC power source. In some embodiments, the toggle switch 110 can be a three-way switch, four-way switch, five-way switch, or other suitable switch that can control the delivery of power to the lighting system 100.

For instance, in one example embodiment, when the user toggles the toggle switch 110 to an off position, the lighting system 100 no longer receives power from the power source and the lighting system 100 is effectively turned off. When the user toggles the toggle switch 110 to an on position, power is delivered from the power source to the lighting system 100 and the lighting system 100 is effectively turned on. As will be discussed in more detail below, various toggle inputs (e.g., different toggle patterns) can be input via the toggle switch 110 to control the power distribution among the plurality of LED arrays 110 and 130 in the lighting system 100 to provide different lighting effects.

For instance, in one embodiment, a user can provide a first toggle input (e.g., a first toggle pattern) via the toggle switch 110 to place the lighting system 100 in a control mode. The first toggle input can be, for instance, a first toggle pattern comprising a plurality of toggles (e.g., two toggles) in succession within a time period (e.g., about 2 seconds). Other suitable toggle patterns can be used as the first toggle input without deviating from the scope of the present disclosure. The lighting system 100 can provide a visual indicator (e.g., can dim the plurality of LED arrays) that can notify the user that the lighting system 100 has entered the control mode. In the control mode, for instance, the power conversion circuit 200 can implement a power distribution sweep among the plurality of LED arrays 120 and 130. The power distribution sweep can vary the power distribution among the plurality of LED arrays 120 and 130 over time to adjust the lighting effects provided by the lighting system 100.

When a desired lighting effect is achieved, a user can provide a second toggle input via the toggle switch 110 to cause the power conversion circuit 200 to stop the power distribution sweep and hold the light output of the lighting system 100. The second toggle input can be, for instance, a second toggle pattern of one or more toggles that occur when the lighting system 100 is in the control mode. The second toggle pattern can be different from the first toggle pattern.

In some embodiments, a user can provide a third toggle input via the toggle switch 110 during the control mode to control the direction of the power distribution sweep during the control mode. The third toggle input can include a toggle pattern comprising plurality of toggles (e.g., two or more toggles) that are received during a specified time period (e.g. two seconds). The third toggle pattern can be the same as or different from the first toggle pattern. The third toggle input can cause the power conversion circuit 200 to change the direction of the power distribution sweep.

For instance, if the power conversion circuit 200 is implementing a power distribution sweep that is increasing power delivered to the first LED array 120 and decreasing power delivered to the second LED array 130, receipt of the third toggle input can change the direction of the power distribution sweep such that the power conversion circuit 200 implements a power distribution sweep that decreases power delivered to the first LED array 120 and increases power delivered to the second LED array 130. The second toggle input provided via the toggle switch 110 can be used to cause the power conversion circuit 200 to stop the power distribution sweep and hold the light output of the lighting system 100.

The power conversion circuit 200 can be configured to exit the control mode a predetermined period of time after the power distribution among the plurality of LED arrays 120 and 130 has been held in response to a second toggle input. When the power conversion circuit 200 exits the control mode, the light output of the lighting system 100 can be controlled between an on state and an off state using the toggle switch 110 as is typically performed in lighting systems.

In some embodiments, a power distribution among the plurality of LED arrays 120 and 130 can be programmed or otherwise stored in a memory device associated with the power conversion circuit 200. The power conversion circuit 200 can be configured to provide power to the plurality of LED arrays 120 and 130 in accordance with the programmed power distribution when the power conversion circuit exits the control mode. In this way, a user can use the toggle switch to simply toggle the LED arrays 120 and 130 on and off without having to implement the power distribution sweep to find a desired light output every time the user operates the lighting system 100.

Figure 2:
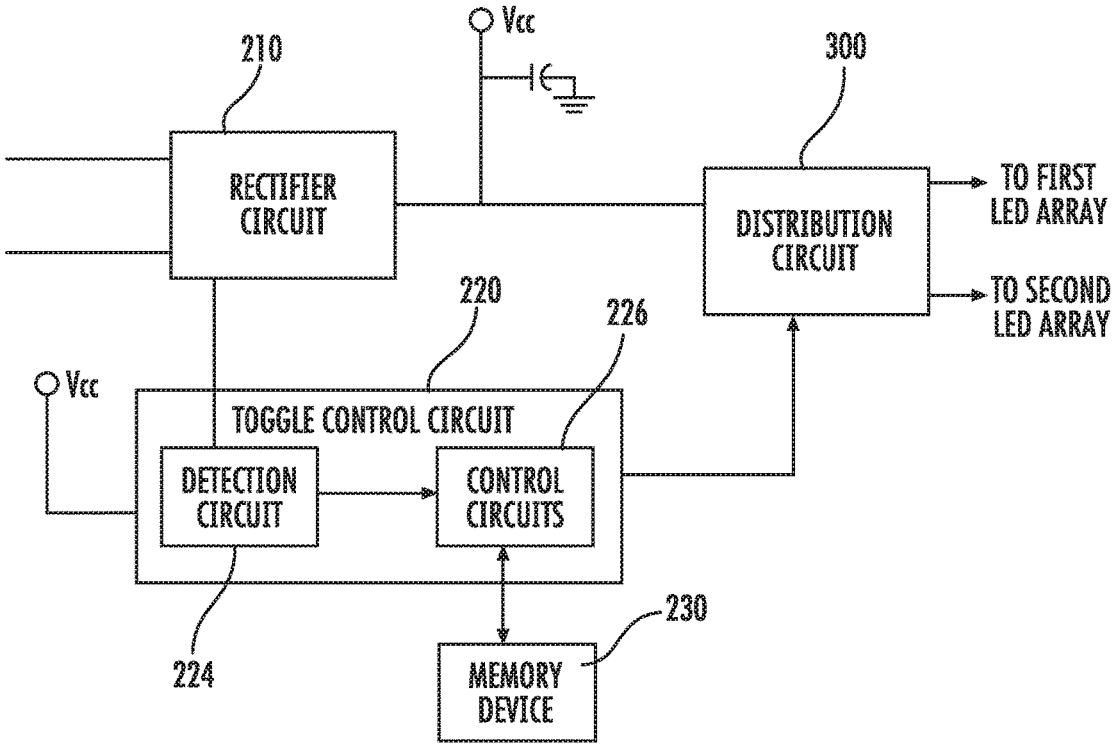
FIG. 2 depicts a schematic of an example power conversion circuit according to example embodiments of the present disclosure.

FIG. 2 depicts an example power conversion circuit 200 configured to implement lighting control based on toggle inputs according to example embodiments of the present disclosure. The power conversion circuit 200 can include means for controlling a power distribution among the first LED array and the second LED array based on detected toggle inputs provided via the toggle switch.

As shown, the power conversion circuit 200 can include a rectifier circuit 210 configured to convert an AC input (e.g., from the AC power source) to a rectified output. The rectifier circuit 210 can include, for instance, one or more diodes and/or filtering capacitors for half-wave or full wave rectification of AC power. The rectified output can be provided to a distribution circuit 300 that is configured to control a split of driving current between the first LED array 120 and the second LED array 130 according to example embodiments of the present disclosure. The rectifier circuit 210 can also provide a Vcc for powering various aspects of the power conversion circuit 200.

The power conversion circuit 200 can further include a toggle control circuit 220. The toggle control circuit 220 can be configured to detect the various toggle inputs provided via a toggle switch 110 of FIG. 1 and to provide control signals to the distribution circuit 300 to control power distribution among the plurality of LED arrays based at least in part on the detected toggle inputs.

In one implementation, the toggle control circuit 220 can include a detection circuit 224 and one or more control circuits 226. The detection circuit 224 can be configured to detect various toggle inputs and/or toggle patterns provided via the toggle switch 110 of FIG. 1 and can provide signals indicative of the detected toggle inputs to the control circuit 226. The control circuit 226 can determine control signals for controlling the distribution circuit 300 based at least in part on the detected toggle inputs.

In one embodiment, the detection circuit 224 can be configured to detect toggle inputs by monitoring for interruptions in power delivered from the toggle switch 110. For instance, voltage sensing circuits can be used to detect for interruptions in power (e.g., AC power or rectified power) that occur within specified time periods and can provide signals indicative of the interruptions to the control circuit 226. In one embodiment, the detection circuit includes a capacitor that is discharged during interruptions in power attributable to the toggle switch 110. When the voltage of the capacitor drops below a threshold, a signal indicative of a toggle can be provided by the detection circuit 224 to the control circuit 226.

In other embodiments, the detection circuit 224 can be configured to detect one or more toggle inputs using digital load-side transmission (DLT) and/or power line communication (PLC) protocols or other suitable PLC protocols. In these embodiments, the toggle switch 110 can be configured to encode information in AC power delivered via the toggle switch for detection by the detection circuit 220. The detection circuit 220 can detect the information using suitable DLT or other PLC detection techniques.

For example, in one embodiment, the detection circuit 224 can include, for instance, an active band pass filter with a Schmitt trigger circuit. The Schmitt trigger can provide a signal indicative of a toggle to the control circuitry 226 upon detection of leading or falling edges attributable to the toggle input provided via the toggle switch 11. In other example embodiments, the detection circuit 224 can include one or more digital circuits (e.g., microcontrollers, microprocessors, logic devices, application specific integrated circuits, etc.) configured to detect interruptions (e.g., leading or falling edges) attributable to toggle inputs provided via the toggle switch. Other suitable detection circuits 224 configured to detect toggle patterns can be used without deviating from the scope of the present disclosure.

The control circuit 226 can include one or more control devices (e.g., one or more microcontrollers, microprocessors, logic circuits, application specific integrated circuit (ASIC), etc.) configured to receive the signals from the detection circuit 224 indicative of a toggle input via the toggle switch 110. The control circuit 226 can process the signals indicative of the toggle input and generate one or more lighting control signals for controlling the distribution circuit 300. The lighting control signals can be, for instance, 0V to 10V lighting control signals, a digital addressable lighting interface (DALI) lighting control signal, digital multiplex (DMX) lighting control signal, Power Management IC (PMIC) or other control signal.

In one embodiment, the control circuit 226 can process signals received from the detection circuit 224 to detect various toggle inputs. In response to the various toggle inputs, the control circuit 226 can enter a control mode and provide lighting control signals to the power distribution circuit 300 to implement a power distribution sweep among the plurality of LED arrays according to example aspects of the present disclosure (e.g., using a multichannel driver circuit, current splitter circuit, dim-to-warm circuit, etc).

For example, the control circuit 226 can detect a first toggle input comprising a first toggle pattern. In response to the first toggle input, the control circuit 226 can enter a control mode. During the control mode, the control circuit 226 can adjust the lighting control signals provided to the distribution circuit 300 as discussed in more detail below to implement a power distribution sweep using the distribution circuit 300. The control circuit can be configured to stop or hold the power distribution sweep upon the detection of a second toggle input and/or to change direction of a power distribution sweep using the distribution circuit upon detection of a third toggle input.

As shown in FIG. 2, the power conversion circuit 200 can include one or more memory devices 230 coupled to the control circuit 226. The memory device(s) 230 can store instructions (e.g., firmware) accessible by the control circuit 226 for implementing the control functionality discussed herein, such as the control method discussed with reference to FIG. 5.

In some embodiments, the memory device(s) 230 can store desired power distributions for the lighting system programmed into the memory device. For instance, data indicative a power distribution (e.g., selected using a second toggle input) to provide a desired lighting effect can be stored in the memory device. During normal operation (e.g., when the lighting system is not operating in the control mode), the control circuit 226 can be configured to provide control signals to control the distribution circuit 300 in accordance with the programmed power distribution.

The distribution circuit 300 can be any suitable circuit that can adjust the ratio of power delivered to the first LED array 120 and power delivered to the second LED array 130 based on signals received from the control circuit 226. For instance, the distribution circuit 300 can, in some embodiments, be a multichannel driver circuit configured to provide independent driver currents to each of the plurality of LED arrays 120 and 130.

In some embodiments, the distribution circuit 300 can be, for instance, a dim-to-warm circuit used to control the correlated color temperature of the lighting system in response to dimming of the plurality of LED arrays based on the control signal from the control circuit 226. In other embodiments the distribution circuit 300 can include, for instance, a current splitter circuit used to control the power distribution among the plurality of LED arrays independent of a dimming input based on the control signal from the control circuit 226.

Figure 3:
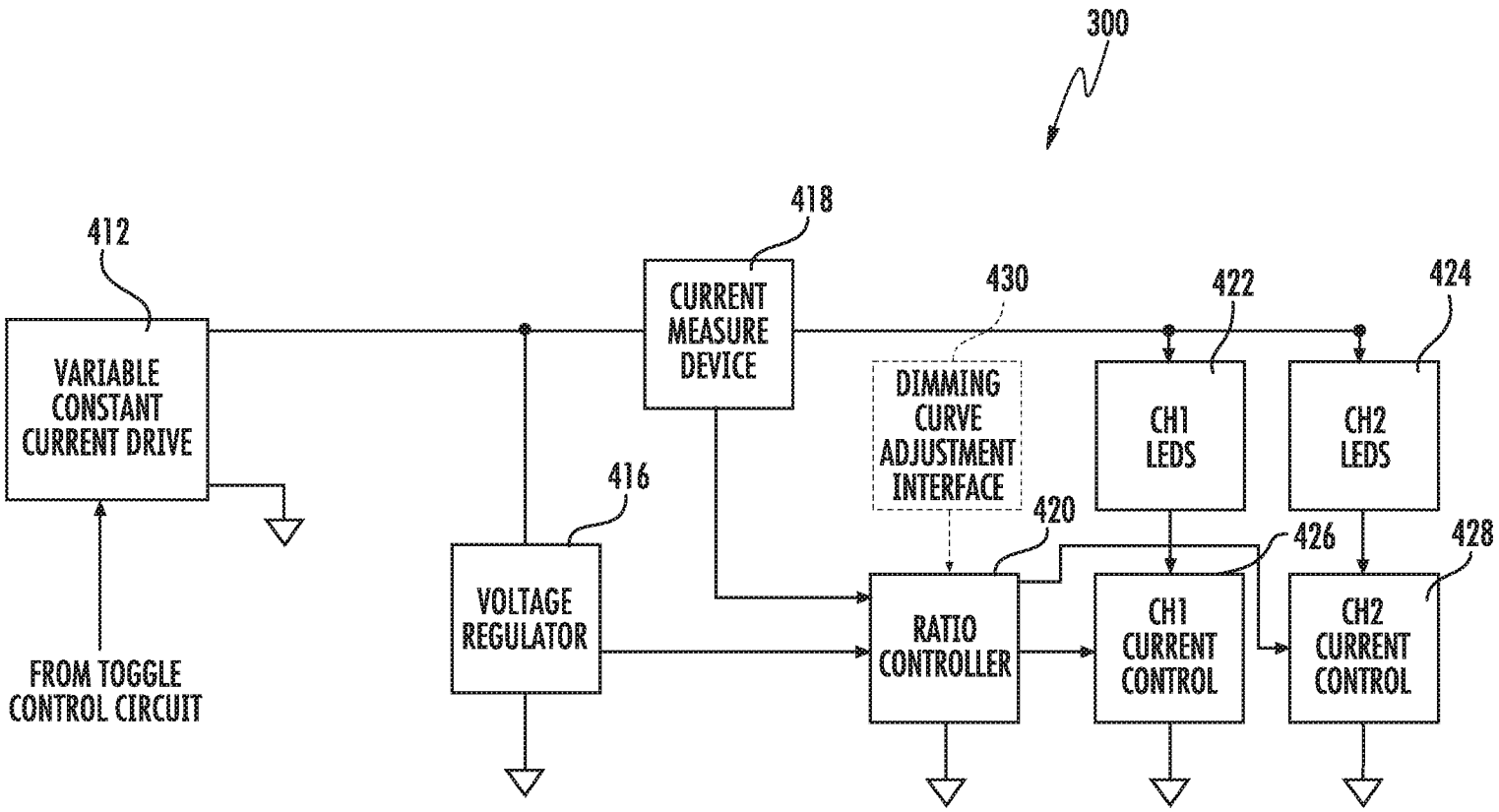
FIG. 3 depicts an example distribution circuit according to example embodiments of the present disclosure.

FIG. 3 depicts a block diagram of an example distribution circuit 300 used to control the correlated color temperature of the lighting system to provide dim-to-warm capability based on toggle inputs according to example embodiments of the present disclosure. The distribution circuit 300 can include a variable constant current drive 412 (e.g., a driver circuit) configured to receive power, for instance, from the rectifier circuit 210 of FIG. 2. The variable constant current drive 412 can output a direct current (DC) for powering the plurality of LED arrays.

The variable constant current drive 412 can receive a control signal from the toggle control circuit 220 of FIG. 2 to control the magnitude of the DC current from about a 10% value to about 100% or maximum current output. For instance, the toggle control circuit 220 of FIG. 2 can provide one or more control signals to vary the magnitude of the DC current in a first direction (e.g., can decrease the magnitude of the DC current) in response to a first toggle input. The control circuit 226 can provide one or more control signals to hold the DC current at a specific magnitude in response to a second toggle input. The toggle control circuit can provide one or more control signals to change the direction of the varying magnitude of the DC current (e.g., can increase the magnitude of the DC current) in response to a third toggle input.

Referring to FIG. 3, a voltage regulator 416 can receive the input current from the current drive 412. A current measure device 418 can receive and measure the current output from the current drive 412 and can output a measured current value.

A controller 420, such as a ratio controller, can receive inputs from the voltage regulator 416 and the current measure device 418. The controller 420 can include one or more control devices (e.g., one or more microcontrollers, microprocessors, logic circuits, application specific integrated circuit (ASIC), etc.) The controller 420 can be configured to process the measured current value and output current values as discussed in detail below.

A first light channel 422 and a second light channel 424 can receive the current output by the current drive 412. In one embodiment, the first light channel 422 can include the first LED array 120 of FIG. 1. The second light channel 424 can include the second LED array 130 of FIG. 1.

The first light channel 422 can be electrically connected in series to a first current control 426 whereby current passes through the first light channel 422 and the first current control 426. The first current control 426 receives a current value output by controller 420. In one embodiment, the first current control 426 is a gated transistor and the current value is provided to the gate.

The second light channel 424 can be electrically connected in series to a second current control 428 whereby current passes through the second light channel 424 and the second current control 428. The second current control 428 also receives a current value output by controller 420. In one embodiment, the second current control 428 is a gated transistor and the current value is provided to the gate.

An optional dimming curve adjustment interface 430 can be provided to communicate with the controller 420 to adjust a dimming curve for the combination of light channels that is stored in the controller 420. In one embodiment, the dimming curve adjustment interface 430 is a Bluetooth wireless device for wireless communication with the controller 420. In other embodiments, the dimming curve adjustment interface 430 is a resistor that connects to pins of a processor of the controller 420. Other arrangements are contemplated.

The voltage regulator 416 can receive a small or negligible portion of the current output from the current drive 412. The voltage regulator 416 can output a small voltage to the controller 420 to power the controller 420. The voltage regulator 416 can be configured so that adequate voltage is provided to power the controller 420 even if the current from the current drive is less than 10% of its maximum current value, and even less than 5% or other suitable threshold in some embodiments.

In operation, the DC current that is output by the current drive 412 can be adjusted based on the control signals received from the toggle control circuit 220 (FIG. 2). The current output by the current drive 412 can be input to the first light channel 422 and the second light channel 424. The controller 420 can receive a measured current value obtained by the current measuring device 418. The controller 420 can compare the measured current value to a maximum current value for the current drive 412 to calculate or otherwise determine a light control value. In some embodiments, the light control value can be a percentage light control value from 0% to about 100%.

The controller 420 can determine a ratio of current provided to the first light channel 422 relative to the second light channel 424. More specifically, the controller 420 determines how much of the current output by the current drive is provided to each of the light channels 422, 424.

A memory (not shown) provided with the ratio controller 420 can store proportional current values for each of the light channels 422, 424 that correspond to a given percentage light control value. The controller 420 can use the percentage light control value to obtain a current value or percentage for light to be output by the first light channel 422 and a current value or percentage for light to be output by the second light channel 424. Upon the determination of the current values, the controller 420 sends a first current value for applying a first current to the first current control 426 and a second current value for applying a second current to the second current control 428. Thus, the first current is based on the first current value and the second current is based on the second current value. Changing the values of the first current and the second current can result in different desired color temperatures for the light output at different percentage light control values. In this way, the distribution circuit 300 of FIG. 3 can be used to provide dim-to-warm functionality based at least in part on toggle inputs detected by the toggle control circuit 220 (FIG. 2).

Figure 4:
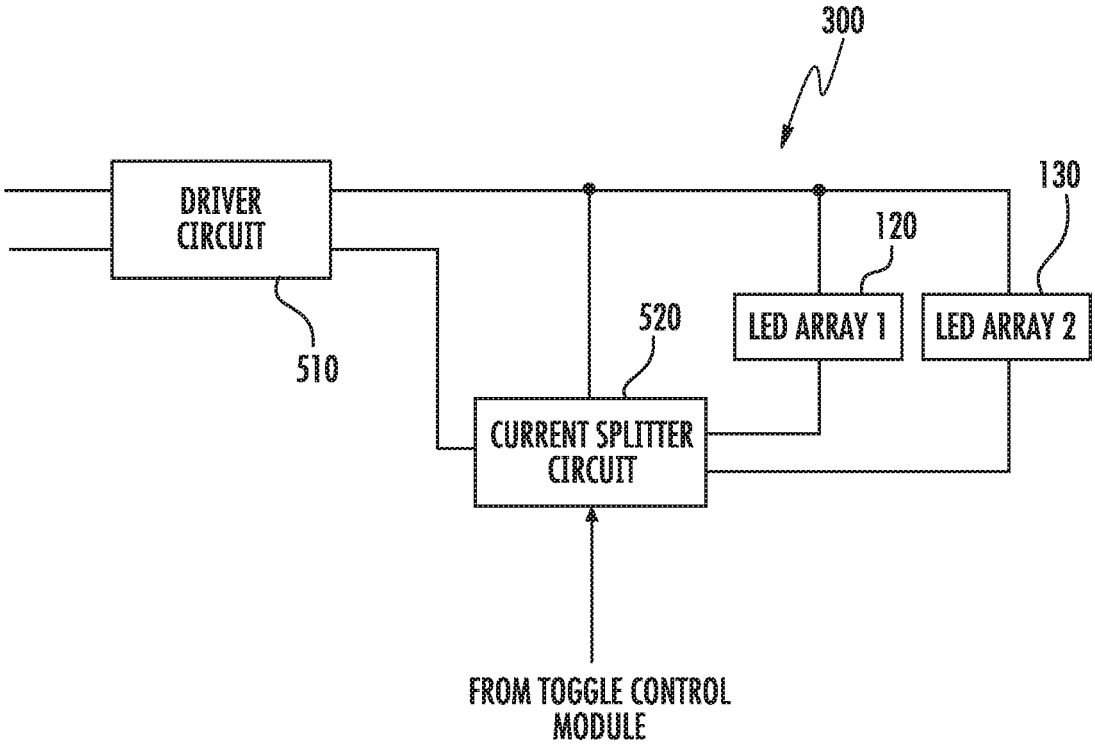
FIG. 4 depicts an example distribution circuit according to example embodiments of the present disclosure.

FIG. 4 depicts a block diagram of an example power distribution circuit 300 including a current splitter system used to control the power distribution among a plurality of LED arrays according to example embodiments of the present disclosure. The current splitter system can control the power distribution among the plurality of LED arrays independent of dimming of the plurality of LED arrays.

As shown in FIG. 4, the power distribution circuit 300 can include an LED driver circuit 510 and a current splitter circuit 520. The LED driver circuit 510 can be configured to receive an input power (e.g., from the rectifier circuit 210 of FIG. 2), and can convert the input power to a suitable driver output (e.g. driver current) for powering the plurality of LED arrays 120 and 130. In some embodiments, the driver circuit 510 can include various components, such as switching elements (e.g. transistors) that are controlled to provide a suitable driver output. For instance, in one embodiment, the driver circuit 510 can include one or more transistors. Gate timing commands can be provided to the one or more transistors to convert the input power to a suitable driver output using pulse width modulation techniques. In some embodiments, the driver circuit 510 can be a dimmable driver circuit.

As illustrated in FIG. 4, the driver output can be provided to a current splitter circuit 520. The current splitter circuit 520 can be configured to split the driver output into a first current for powering the first LED array 120 and a second current for powering the second LED array 130. In this way, the current splitter circuit 520 can be used to adjust the light output of the first LED array 120 relative to the light output of the second LED array 130. The current splitter circuit 520 can be configured to control the current ratio of the first current provided to the first LED array 120 to the second current provided to the second LED array 130 based on a lighting control signal received from the toggle control circuit 220 of FIG. 2.

For instance, the toggle control circuit 220 of FIG. 2 can provide one or more control signals to implement a power distribution sweep in response to a first toggle input. During the power distribution sweep, the current splitter circuit 520 can adjust the current ratio over time between the first LED array and the second LED array. For instance the current splitter circuit 520 can increase the driving current provided to the first LED array while decreasing the driving current provided to the second LED array. In response to a second toggle input, the toggle control circuit 220 can provide a control signal to the current splitter circuit 520 to hold the current split at a specific current ratio between the first LED array and the second LED array. In response to a third toggle input, the toggle control circuit 220 can provide a control signal to the current splitter circuit 520 to change the direction of the power distribution sweep.

The current splitter circuit 520 can include one or more control devices (e.g. a microprocessor, a microcontroller, logic device, etc.) and one or more switching elements (e.g. transistors) in line with each of the first LED array 120 and the second LED array 130. The control device(s) can control the amount of current provided to the first LED array 120 and the second LED array 130 by controlling the switching elements. The switching elements used to control the amount of current provided to the first LED array 120 and to the second LED array 130 can be either on the low voltage side of the LED arrays or the high voltage side of the LED arrays.

In particular aspects, the control device(s) can control the current provided to the first LED array 120 and to the second LED array 130 according to a current ratio control curve based on the lighting control signal. The current ratio control curve can be stored in firmware or stored in a memory accessible by the control device. The current ratio control curve can specify the current ratio of the first current provided to the first LED array 120 and the second current provided to the second LED array 130 as a function of at least the control signal received from the toggle control circuit 220 of FIG. 2. The current ratio control curve can specify, for instance, comprises a linear, super-linear, parabolic, logarithmic, asymptotic, or exponential relationship between the current ratio and the lighting control signal received from the toggle control circuit 220.

Figure 5:
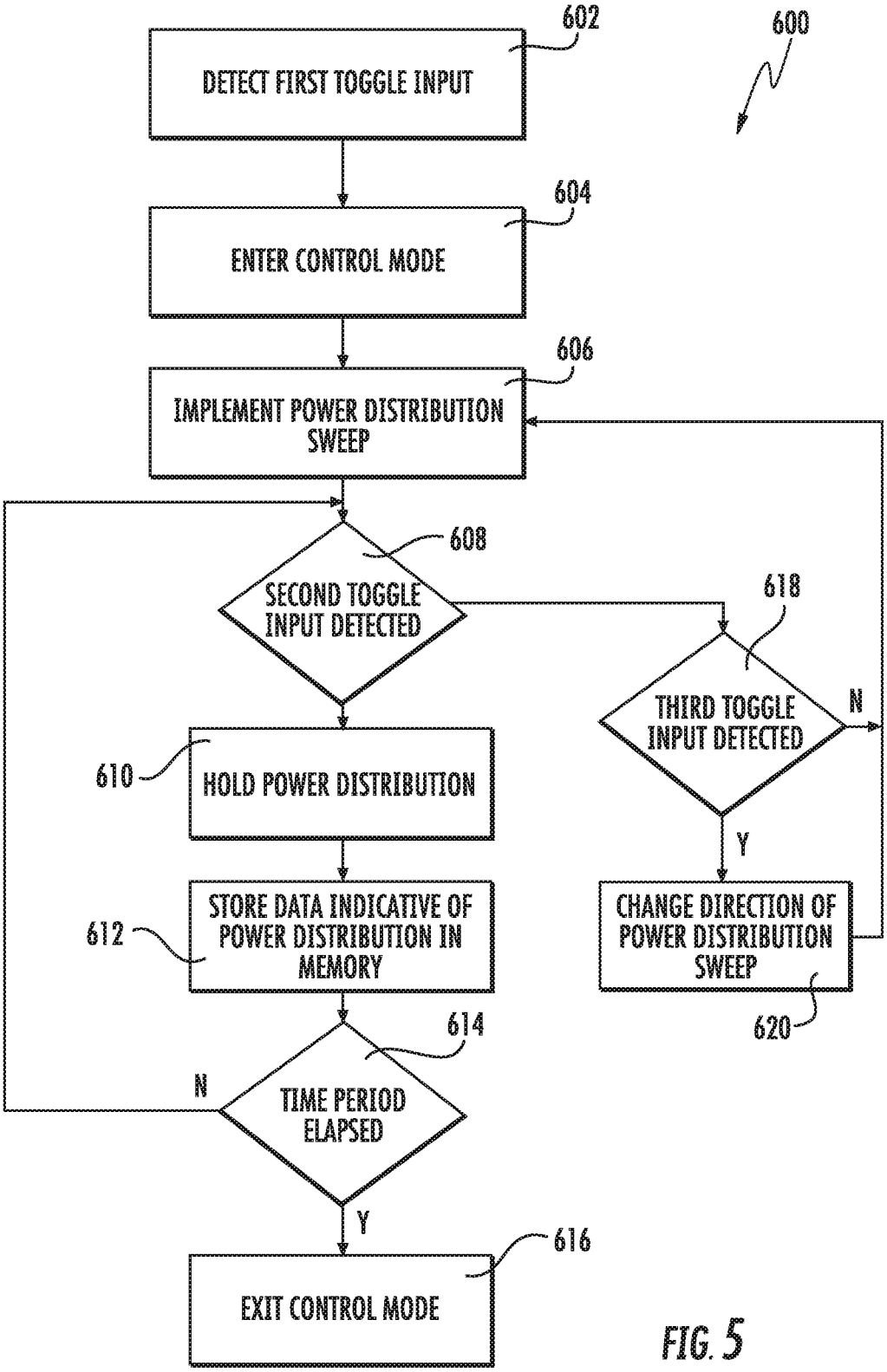
FIG. 5 depicts a flow diagram of an example control method implemented based at least in part on toggle input provided via a toggle switch according to example embodiments of the present disclosure.

FIG. 5 depicts a flow diagram of one example control method (600) that can be implemented using the lighting system according to example embodiments of the present disclosure. The method can be implemented, for instance, using the lighting system 100 having a plurality of LED arrays of FIG. 1. In addition, FIG. 5 depicts steps performed in a particular order for purposes of illustration and discussion. Those of ordinary skill in the art, using the disclosures provided herein will understand that various steps of any of the methods provided herein can be adapted, modified, rearranged, performed simultaneously, omitted, or expanded in various ways without deviating from the scope of the present disclosure.

At (602), a first toggle input provided via a toggle switch can be detected. For instance, a toggle control circuit can detect a toggle input by the toggle switch 110 shown in FIG. 1. The first toggle input can be a first toggle pattern including a plurality of successive toggles (e.g., two toggles) that occur within a specified time period.

In response to the first toggle input, the lighting system can enter a control mode (604). When in the control mode, the lighting system can be controlled to adjust a power distribution between the plurality of LED arrays using various toggle patterns provided via the toggle switch.

At (606), the method can implement a power distribution sweep among the plurality of LED arrays. For instance, a power (e.g., driving current) provided to a first LED array having one or more LED devices can be increased while a power provided to a second LED array having one or more LED devices can be decreased. Adjusting the power distribution among the plurality of LED arrays can provide variations in the light output of the LED system (e.g., variations in color temperature, lighting direction, or other lighting effects).

At (608) it can be determined whether a second toggle input has been provided via the toggle switch. The second toggle input can be a second toggle pattern including one or more toggles. The second toggle pattern can be different from the first toggle pattern. When the second toggle input is detected, the power distribution among the plurality of LED arrays can be held at its current state so that the lighting system provides a desired light output as shown at (610). Data indicative of the power distribution can also be stored in a memory device as shown at (612) so that the lighting system defaults to the selected power distribution when being turned on and off with the toggle switch. At (614) it is determined whether a predetermined period of time has passed (e.g., 5 or more seconds) since the second toggle input has been detected. If so, the method can exit the control mode as shown at (616), otherwise the method can continue to monitor for second toggle inputs or third toggle inputs as illustrated in FIG. 5.

In the event a second toggle input is not detected at (608), the method determines whether a third toggle input has been received at (618). If the third toggle input has been detected, the method can change the direction of the power distribution sweep (620). Otherwise, the method can continue to implement the power distribution sweep implemented in response to the first toggle input as shown at (606).

FIG. 5 depicts one example control method that can be implemented using a toggle switch according to example embodiments of the present disclosure for purposes of illustration and discussion. Those of ordinary skill in the art, using the disclosures provided herein, will understand that a variety of different control schemes can be developed for controlling the power distribution among a plurality of LED arrays in response to various toggle inputs without deviating from the scope of the present disclosure.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A lighting fixture, comprising:

a first LED array associated with a first color temperature;

a second LED array associated with a second color temperature; and a circuit configured to adjust a power distribution amongst the first LED array and the second LED array based at least in part on a detected toggle input to adjust a color temperature of light output by the lighting fixture.

2. The lighting fixture of claim 1, wherein the circuit is configured to adjust the color temperature of the light output to correspond to a color temperature of about 3000 Kelvin.

3. The lighting fixture of claim 1, wherein the circuit is configured to adjust the color temperature of the light output to correspond to a color temperature of about 4000 Kelvin.

4. The lighting fixture of claim 1, wherein the circuit is configured to adjust the color temperature of the light output to correspond to a color temperature of about 5000 Kelvin.

5. The lighting fixture of claim 1, wherein the circuit is further configured to convert an input power to an output power for the first LED array and the second LED array.

6. The lighting fixture of claim 5, wherein the circuit is configured to adjust the power distribution amongst the first LED array and the second LED array such that the first LED array receives 100 percent of the output power and the second LED array receives 0 percent of the output power.

7. The lighting fixture of claim 5, wherein the circuit is configured to adjust the power distribution amongst the first LED array and the second LED array such that the first LED array receives 0 percent of the output power and the second LED array receives 100 percent of the output power.

8. The lighting fixture of claim 5, wherein the circuit is configured to adjust the power distribution amongst the first LED array and the second LED array such that the output power is split between the first LED array and the second LED array.

9. The lighting fixture of claim 1, wherein the circuit is configured to sweep a power distribution amongst the first LED array and the second LED array to adjust the color temperature of the light output by the lighting fixture.

10. The lighting fixture of claim 1, wherein the circuit is configured to adjust the color temperature of the light output by the lighting fixture from a color temperature of about 3000K to a color temperature of about 4000K.

11. The lighting fixture of claim 1, wherein the circuit is configured to adjust the color temperature of the light output by the lighting fixture from a color temperature of about 4000K to a color temperature of about 5000K.

12. The lighting fixture of claim 1, wherein the circuit comprises a toggle control circuit configured to detect the toggle input and to provide one or more control signals to a distribution circuit based at least in part on the toggle input to adjust the color temperature of the light output by the lighting fixture.

13. The lighting fixture of claim 1, wherein the toggle input comprises a plurality of successive toggles within a time period.

14. The lighting fixture of claim 1, wherein the toggle input is implemented using a single throw circuit interrupter.

15. The lighting fixture of claim 14, wherein the single throw circuit interrupter comprises a toggle switch.

16. A method for controlling a lighting fixture comprising a first LED array associated with a first color temperature and a second LED array associated with a second color temperature, the method comprising:

detecting a toggle input; and responsive to detecting the toggle input, adjusting a power distribution amongst the first LED array and the second LED array to adjust a color temperature of light output by the lighting fixture.

17. The method of claim 16, wherein adjusting a power distribution amongst the first LED array and the second LED array comprises:

adjusting the power distribution amongst the first LED array and the second LED array to adjust the color temperature of the light output by the lighting fixture from a color temperature of about 3000 Kelvin to a color temperature of about 4000 Kelvin.

18. The method of claim 16, wherein adjusting a power distribution amongst the first LED array and the second LED array comprises:

adjusting the power distribution amongst the first LED array and the second LED array to adjust the color temperature of the light output by the lighting fixture from a color temperature of about 4000 Kelvin to a color temperature of about 5000 Kelvin.

19. The method of claim 16, wherein adjusting a power distribution amongst the first LED array and the second LED array comprises:

sweeping the power distribution amongst the first LED array and the second LED array to adjust the color temperature of the light output by the fixture.

* * * * *